US010160926B2

(12) United States Patent
Lee

(10) Patent No.: US 10,160,926 B2
(45) Date of Patent: Dec. 25, 2018

(54) AXLE OIL COMPOSITION HAVING ENHANCED FUEL EFFICIENCY AND LOW VISCOSITY

(71) Applicant: Hyundai Motor Company, Seoul (KR)

(72) Inventor: Sung Uk Lee, Boryeong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/486,090

(22) Filed: Apr. 12, 2017

(65) Prior Publication Data

US 2018/0148661 A1 May 31, 2018

(30) Foreign Application Priority Data

Nov. 25, 2016 (KR) ..... 10-2016-0158361

(51) Int. Cl.

| | |
|---|---|
| ***C10M 125/10*** | (2006.01) |
| ***C10M 105/04*** | (2006.01) |
| ***C10M 107/34*** | (2006.01) |
| ***C10M 133/58*** | (2006.01) |
| ***C10M 137/04*** | (2006.01) |
| ***C10M 137/10*** | (2006.01) |
| ***C10M 145/22*** | (2006.01) |
| ***C10M 169/04*** | (2006.01) |

(52) U.S. Cl.

CPC ..... *C10M 125/10* (2013.01); *C10M 105/04* (2013.01); *C10M 107/34* (2013.01); *C10M 133/58* (2013.01); *C10M 137/04* (2013.01); *C10M 137/10* (2013.01); *C10M 145/22* (2013.01); *C10M 169/044* (2013.01); *C10M 2201/062* (2013.01); *C10M 2203/024* (2013.01); *C10M 2205/028* (2013.01); *C10M 2205/0285* (2013.01); *C10M 2209/084* (2013.01); *C10M 2209/102* (2013.01); *C10M 2209/103* (2013.01); *C10M 2209/1033* (2013.01); *C10M 2215/28* (2013.01); *C10M 2215/30* (2013.01); *C10M 2219/08* (2013.01); *C10M 2223/04* (2013.01); *C10M 2223/045* (2013.01); *C10M 2223/047* (2013.01); *C10N 2210/02* (2013.01); *C10N 2220/022* (2013.01); *C10N 2220/082* (2013.01); *C10N 2230/02* (2013.01); *C10N 2230/04* (2013.01); *C10N 2230/06* (2013.01); *C10N 2230/10* (2013.01); *C10N 2230/54* (2013.01); *C10N 2240/04* (2013.01)

(58) Field of Classification Search

CPC ..... C10N 2240/04; C10N 2240/042; C10N 2240/044; C10N 2240/045; C10N 2240/046

See application file for complete search history.

(56) References Cited

U.S. PATENT DOCUMENTS

| | | | | |
|---|---|---|---|---|
| 9,758,743 | B2 * | 9/2017 | Knapton | C10M 157/04 |
| 2006/0183650 | A1 * | 8/2006 | Carrick | C01F 11/184 508/391 |
| 2014/0113847 | A1 * | 4/2014 | Givens | C10M 149/06 508/468 |
| 2014/0364348 | A1 * | 12/2014 | Malshe | C10M 171/06 508/117 |
| 2015/0087567 | A1 * | 3/2015 | Ushioda | C10M 163/00 508/198 |
| 2015/0275124 | A1 * | 10/2015 | Greaves | C10M 169/041 508/579 |
| 2015/0353861 | A1 * | 12/2015 | Lee | C10M 169/042 508/459 |
| 2016/0083671 | A1 * | 3/2016 | Yao | C10M 169/04 508/296 |
| 2016/0168502 | A1 * | 6/2016 | Lee | C10M 111/04 508/185 |
| 2016/0168504 | A1 * | 6/2016 | Lee | C10M 169/041 508/505 |
| 2016/0201003 | A1 * | 7/2016 | Iwai | C10M 159/22 508/391 |
| 2016/0208192 | A1 * | 7/2016 | Iwai | C10M 159/22 |
| 2016/0222312 | A1 * | 8/2016 | Iwai | C10M 159/22 |
| 2016/0230113 | A1 * | 8/2016 | Bera | C10M 161/00 |
| 2016/0257902 | A1 * | 9/2016 | Ono | C10M 169/04 |
| 2017/0137738 | A1 * | 5/2017 | Hobson | C10M 127/04 |
| 2017/0226442 | A1 * | 8/2017 | Sanson | C10M 107/34 |

FOREIGN PATENT DOCUMENTS

| | | | |
|---|---|---|---|
| JP | 2007-530732 | A | 11/2007 |
| KR | 10-2005-0067613 | A | 7/2005 |
| WO | WO 2013/123160 | A1 | 8/2013 |

* cited by examiner

*Primary Examiner* — Ellen M McAvoy

(74) *Attorney, Agent, or Firm* — Morgan, Lewis & Bockius LLP

(57) ABSTRACT

An axle oil composition having enhanced fuel efficiency and low viscosity is provided, wherein the axle oil composition contains 40 to 70 wt % of poly alpha olefin (PAO) synthetic oil; 5 to 35 wt % of an oil soluble poly alkylene glycol (OSP) synthetic oil; 15 to 20 wt % of an ester-based viscosity modifier; 0.05 to 0.5 wt % of calcite; and 5 to 20 wt % of additive, wherein the axle oil composition having enhanced fuel efficiency and low viscosity has average kinematic viscosity at 100° C. of 11.5 to 13.5 cSt and average kinematic viscosity at 40° C. of 65 to 75 cSt and forms an oil film having a thickness of 85 to 96 nm even at low viscosity, largely improving durability and fuel efficiency of a vehicle.

5 Claims, No Drawings

AXLE OIL COMPOSITION HAVING ENHANCED FUEL EFFICIENCY AND LOW VISCOSITY

CROSS-REFERENCE TO RELATED APPLICATION

The present application claims priority to Korean Patent Application No. 10-2016-0158361 filed on Nov. 25, 2016, the entire contents of which are incorporated herein for all purposes by this reference.

BACKGROUND OF THE INVENTION

Field of the Invention

The present invention relates to an axle oil composition having enhanced fuel efficiency and low viscosity. More particularly, it relates to an axle oil composition having enhanced fuel efficiency and low viscosity capable of improving fuel efficiency and durability of a vehicle by mixing and using an ester-based viscosity modifier and calcite with poly alpha olefin (PAO) synthetic oil and oil soluble poly alkylene glycol (OSP) synthetic oil in an appropriate ratio to form a thick oil film even at low viscosity.

Description of Related Art

In general, axle oil used in vehicles, industrial machines, or the like serves to form a sufficient oil film on a contact portion of respective gears and various components in an axle housing to lubricate the components. Particularly, in the axle oil, appropriate viscosity for forming a sufficient oil film on all friction portions is required due to harsh environmental factors such as large load, pressure, and a temperature change by engagement of various components.

As a kind of axle oil, transmission oil or engine oil of vehicles or agricultural machinery is included. The axle oil is mainly prepared by using petroleum-derived base oils, but there is a problem in that viscosity and the like are not still satisfied by harsh and extreme environmental conditions and thus durability and the like are weak.

The information disclosed in this Background of the Invention section is only for enhancement of understanding of the general background of the invention and should not be taken as an acknowledgement or any form of suggestion that this information forms the related art already known to a person skilled in the art.

BRIEF SUMMARY

To solve the problems, the inventors found that when an ester-based viscosity modifier, calcite and general additives are mixed and used with poly alpha olefin (PAO) synthetic oil and oil soluble poly alkylene glycol (OSP) synthetic oil, a thick oil film is formed at low viscosity to largely enhance fuel efficiency and durability of a vehicle, and completed the present invention.

Therefore, various aspects of the present invention are directed to providing an axle oil composition having average kinematic viscosity at 100° C. of 11.5 to 13.5 cSt and average kinematic viscosity at 40° C. of 65 to 75 cSt and being configured for forming a thick oil film at low viscosity.

Various aspects of the present invention are directed to providing an axle oil composition containing 40 to 70 wt % of poly alpha olefin (PAO) synthetic oil; 5 to 35 wt % of an oil soluble poly alkylene glycol (OSP) synthetic oil; 15 to 20 wt % of an ester-based viscosity modifier; 0.05 to 0.5 wt % of calcite; and 5 to 20 wt % of additives.

According to an exemplary embodiment of the present invention, the axle oil composition has average kinematic viscosity at 100° C. of 11.5 to 13.5 cSt and average kinematic viscosity at 40° C. of 65 to 75 cSt and can form an oil film having a thickness of 85 to 96 nm even at low viscosity.

The axle oil composition of the present invention forms a thick oil film even at low viscosity by mixing and using an ester-based viscosity modifier, calcite and general additives with poly alpha olefin (PAO) synthetic oil and oil soluble poly alkylene glycol (OSP) synthetic oil to largely enhance durability and fuel efficiency of the vehicle.

Other aspects and exemplary embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles. The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, the present invention will be described in more detail as one exemplary embodiment.

An axle oil composition according to an exemplary embodiment of the present invention includes (1) poly alpha olefin (PAO) synthetic oil, (2) poly alkylene glycol (OSP) synthetic oil, (3) an ester-based viscosity modifier, (4) calcite, and (5) general additives.

An exemplary embodiment of the present invention provides an axle oil composition containing 40 to 70 wt % of poly alpha olefin (PAO) synthetic oil; 5 to 35 wt % of an oil soluble poly alkylene glycol (OSP) synthetic oil; 15 to 20 wt % of an ester-based viscosity modifier; 0.05 to 0.5 wt % of calcite; and 5 to 20 wt % of additives.

Respective ingredients which are included in the axle oil composition of the present invention will be described below in more detail.

Poly alpha olefin (PAO) synthetic oil

According to an exemplary embodiment of the present invention, the content of the poly alpha olefin (PAO) synthetic oil may be 40 to 70 wt % with respect to the entire weight of the axle oil composition. The poly alpha olefin (PAO) synthetic oil may have average kinematic viscosity at 100° C. of 3 to 8 cSt, a viscosity index of 130 or more, and a flow point of −50° C. or less. The poly alpha olefin (PAO) synthetic oil may have average kinematic viscosity at 100° C. of 3 to 8 cSt, a viscosity index of 130 to 150, and a flow point of −70° C. to −50° C.

(2) Oil Soluble Poly Alkylene Glycol (OSP) Synthetic Oil

According to an exemplary embodiment of the present invention, the content of oil soluble poly alkylene glycol (OSP) synthetic oil may be 5 to 35 wt % with respect to the entire weight of the axle oil composition. In the instant case, when the content is smaller than 5 wt %, effects of improving efficiency due to an increase in oil film and durability life may not be expected and when the content is larger than 35 wt %, the additives may be precipitated.

The poly alkylene glycol is a polymer obtained by copolymerizing alkylene oxides including ethylene oxide (EO), propylene oxide (PO), and butylene oxide (BO), and in an exemplary embodiment of the present invention, the oil soluble poly alkylene glycol (OSP) used as base oil is a polymer obtained by copolymerizing ethylene oxide, butylene oxide having a higher carbon content than propylene oxide, and styrene oxide and has solubility for oil unlike conventional poly alkylene glycol and flowability.

The oil soluble poly alkylene glycol (OSP) synthetic oil may have average kinematic viscosity at 100° C. of 3 to 8 cSt, a viscosity index of 140 or more, and a flow point of −40° C. or less. The oil soluble poly alkylene glycol (OSP) synthetic oil has average kinematic viscosity at 100° C. of 6 to 12 cSt, a viscosity index of 140 to 160, and a flow point of −60° C. to −40° C.

In the poly alpha olefin (PAO) synthetic oil and the oil soluble poly alkylene glycol (OSP) synthetic oil described above, when the kinematic viscosity at 100° C. is less than the range, there is a problem in that gear wear is increased, and when the kinematic viscosity is more than the range, there is problem in that the viscosity at a low temperature is severely increased and operability and fuel efficiency at the low temperature deteriorate.

(3) Ester-Based Viscosity Modifier

According to an exemplary embodiment of the present invention, the ester-based viscosity modifier is configured to increase viscosity of the axle oil and enhance a viscosity index by suppressing a viscosity increase at a low temperature. The content of the ester-based viscosity modifier may be 15 to 20 wt % with respect to the entire weight of the axle oil composition. In the instant case, when the content is smaller than 15 wt %, the viscosity is very low and thus a desired durability life effect is not satisfied, and when the content is larger than 20 wt %, the viscosity is increased and formation efficiency of the axle oil film deteriorates.

The ester-based viscosity modifier may use a hybrid olefin ester copolymer having a backbone containing units induced from (i) $C_6$ or more of α-olefin monomers; and (ii) ethylenically unsaturated carboxylic acid. In the backbone, vinyl aromatic compound monomers may be further included. In the instant case, a mole ratio of (i) $C_6$ or more of α-olefin monomers to (ii) ethylenically unsaturated carboxylic acids or the derivatives of them is 1:3 to 3:1, and the copolymer selectively includes a nitrogen functional group. Further, the ester functional group of the copolymer is derived from an alcohol mixture (referred to as an ester-based copolymer disclosed in International Publication No. WO2013-123160). The ester-based viscosity modifier may have kinematic viscosity at 100° C. of 200 cSt. Further, a shear stability index (SSI) may be 3%. Herein, the SSI represents a characteristic in which while a polymer is broken by physical force, viscosity deteriorates, and 3% represents a deterioration degree of viscosity before and after bearing durability. As a representative viscosity modifier, Meridian™ (VH1200L) by Lubrizol Corporation which is commercially available may be used.

(4) Calcite

According to an exemplary embodiment of the present invention, the calcite may are configured to adjust an excessive viscosity increase at room temperature and a high temperature by reducing a temperature of the axle oil. The calcite is configured to enhance high axle efficiency compared with the same viscosity and high durability. Further, the calcite adjusts an excessive viscosity increase to form a thick oil film even at low viscosity.

The content of the calcite may be 0.05 to 0.5 wt % with respect to the entire weight of the axle oil composition. In the instant case, when the content is smaller than 0.05 wt %, an effect of reducing the temperature of the axle oil is decreased, and when the content is larger than 0.5 wt %, a precipitation problem of the ester-based viscosity modifier may be caused. The calcite has a plate-shaped structure in which amorphous calcium carbonate ($CaCO_3$) is atomized and an average particle size may be 1 to 10 nm.

(5) Additives

In the axle oil composition according to an exemplary embodiment of the present invention, additives which are used in the art may be appropriately and selectively added when necessary. API GL-5-grade approved or SAE J 2360 approved additives may be used.

A gear oil composition of the present invention may include general additives by selection and the present invention is not limited by a used amount of the general additives. Nevertheless, if the content should be limited, the content of the additives may be 5 to 20 wt % with respect to the entire weight of the axle oil composition.

The additives may use at least one selected from a group consisting of a dithiophosphate-based wear-resistant agent, a calcium-based detergent dispersant, a phosphate ester-based friction modifier, a bis-succinimide type ashless dispersant, a polysulfide extreme pressure agent, and an antioxidant.

The axle oil composition of the present invention including the ingredients and the composition ratio described above has average kinematic viscosity at 100° C. of 11.5 to 13.5 cSt and average kinematic viscosity at 40° C. of 65 to 75 cSt and can form an oil film having a thickness of 85 to 96 nm even at low viscosity.

The axle oil composition of the present invention forms a thick oil film even at low viscosity by mixing and using a specific ester-based viscosity modifier, calcite and general additives with poly alpha olefin (PAO) synthetic oil and oil soluble poly alkylene glycol (OSP) synthetic oil to largely enhance durability and fuel efficiency of the vehicle.

Hereinafter, the present invention will be described in more detail based on Examples and the present invention is not limited by the following Examples.

EXAMPLES

The following examples illustrate the invention and are not intended to limit the same.

Examples 1 to 4 and Comparative Examples 1 to 9

Axle oil was prepared by composition ingredients and content ratios illustrated in Table 1 below.

TABLE 1

| Classification | Example | | | | Comparative Example | | | | | | | | |
|---|---|---|---|---|---|---|---|---|---|---|---|---|---|
| (wt %) | 1 | 2 | 3 | 4 | 1 | 2 | 3 | 4 | 5 | 6 | 7 | 8 | 9 |
| PAO[1)] | 69.95 | 44.95 | 64.8 | 41.5 | 84.96 | 59.96 | 74.96 | 64.5 | 69.5 | 75 | 55 | 50 | 54.4 |
| OSP[2)] | 5 | 30 | 5 | 30 | 5 | 30 | — | — | 5 | — | 15 | 35 | 30 |
| Ester-based viscosity modifier[3)] | 15 | 15 | 20 | 18 | — | — | 15 | 25 | — | — | 20 | 5 | 5 |
| Polyalkyl methacrylate[4)] | — | — | — | — | — | — | — | — | 15 | 15 | — | — | — |
| Additives[5)] | 10 | 10 | 10 | 10 | 10 | 10 | 10 | 10 | 10 | 10 | 10 | 10 | 10 |
| Calcite[6)] | 0.05 | 0.05 | 0.2 | 0.5 | 0.04 | 0.04 | 0.04 | 0.5 | 0.5 | — | — | — | 0.6 |

[1)]PAO: Poly alpha olefin, PAO4 by Eneos Corporation (kinematic viscosity at 100° C. of 5.8 cSt, viscosity index of 130, flow point of −61° C.)
[2)]OSP: Poly alkylene glycol, Ucon-32 by Dow Corporation (kinematic viscosity at 100° C. of 6.5 cSt, viscosity index of 146, flow point of −50° C.)
[3)]Ester-based viscosity modifier: Meridian ™(VH1200L) by Lubrizol Corporation (kinematic viscosity at 100° C. of 200 cSt)
[4)]Polyalkyl methacrylate: 0-050 by Evonik Corporation
[5)]Additive package: Anglamol 6043 by Lubrizol Corporation (including a wear-resistant agent, a detergent dispersant, a friction modifier, a dispersant, an extreme pressure agent and an antioxidant, API GL-5-grade approved or SAE J 2360 approved product)
[6)]Calcite: Powder particles of a plate-shaped structure in which amorphous calcium carbonate ($CaCO_3$) is atomized (average particle size is 1 to 10 nm)

TEST EXAMPLE

With respect to the axle oils prepared in Examples 1 to 4 and Comparative Examples 1 to 9, physical properties were measured by the following method. The result is illustrated in Table 2 below.

[Method of Measuring Physical Properties]

Method of measuring kinematic viscosity: measured by using an ASTM D 445 measuring method.

Method of measuring low-temperature viscosity: measured by using an ASTM D 2983 measuring method.

Method of measuring oil film thickness: measured by EHD equipment by PCS Corporation.

Method of measuring axle transfer efficiency (%): measuring a ratio of power input to transmission to power output from the transmission.

Method of measuring axle durability life: measured by observing a wear state of a gear after measuring durability life at specified torque and rpm for a specified time.

excessively lowered and the durability life was significantly low. Further, in Comparative Examples 3 and 4 without containing the OSP, it was verified that physical conditions including the required axle efficiency, durability life, and axle temperature were not satisfied.

In Comparative Examples 5, 6, and 7, it was verified that the durability life and the axle temperature were decreased depending on the use of the OSP, the ester-based viscosity modifier, and the calcite. Further, in Comparative Examples 8 and 9, it was verified that a precipitate was generated and thus the measurement of the physical properties was not performed.

On the other hand, it was verified that the axle oil compositions in Examples 1 to 4 had average kinematic viscosity at 100° C. of 11.5 to 13.5 cSt and average kinematic viscosity at 40° C. of 65 to 75 cSt. Further, it was verified that the oil film was excellently formed with a thickness of 85 to 96 nm.

TABLE 2

| Classification | Unit | Target value | Example | | | | Comparative Example | | | | | | | | |
|---|---|---|---|---|---|---|---|---|---|---|---|---|---|---|---|
| | | | 1 | 2 | 3 | 4 | 1 | 2 | 3 | 4 | 5 | 6 | 7 | 8 | 9 |
| Kinematic viscosity at 100° C. | cSt | 11.5~13.5 | 11.5 | 11.5 | 13.5 | 13.5 | 6.2 | 6.8 | 11.5 | 15.5 | 11.5 | 11.5 | 10.5 | test impossible | test impossible |
| Kinematic viscosity at 40° C. | cSt | The less, the better | 65 | 65 | 75 | 75 | 35 | 38 | 65 | 90 | 64 | 64 | 65 | | |
| Oil film thickness | nm | The more, the better | 85 | 89 | 93 | 96 | 65 | 68 | 80 | 105 | 80 | 76 | 85 | | |
| Axle efficiency | % | 94 or more | 94.5 | 94.5 | 94.0 | 94.0 | 95.0 | 95.0 | 94.0 | 92.7 | 94.0 | 93.8 | 94.8 | | |
| Axle durability life | Cycle | 150 or more (The more, the better) | 150 ↑ | 150 ↑ | 150 ↑ | 150 ↑ | 40 | 40 | 140 | 150 ↑ | 120 | 110 | 140 | | |
| Axle temperature | ° C. | 150 or less (The less, the better) | 148 | 146 | 142 | 140 | 156 | 156 | 153 | 140 | 148 | 155 | 155 | | |
| Precipitation | — | None | None | None | None | None | None | None | None | None | None | None | None | Precipitation | Precipitation |

According to the result of Table 2, in Comparative Examples 1 and 2, it was shown that when the additives and the calcite particles were just mixed in the mixed oil of the PAO and the OSP, the kinematic viscosity at 100° C. was Besides, it was verified that the precipitate of the additives was never generated and all of physical levels required in evaluation of physical properties including axle efficiency, axle durability life, and an axle temperature were satisfied.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An axle oil composition, comprising:

40 to 70 wt % of poly alpha olefin (PAO) synthetic oil;

5 to 35 wt % of an oil soluble poly alkylene glycol (OSP) synthetic oil;

15 to 20 wt % of an ester-based viscosity modifier;

0.05 to 0.5 wt % of calcite; and 5 to 20 wt % of an additive, wherein the calcite has a plate-shaped structure in which amorphous calcium carbonate ($CaCO_3$) is atomized and an average particle size is 1 nm to 10 nm and wherein the axle oil composition has average kinematic viscosity at 100° C. of 11 to 14 cSt and average kinematic viscosity at 40° C. of 60 to 80 cSt.

2. The axle oil composition of claim 1, wherein the poly alpha olefin (PAO) synthetic oil has average kinematic viscosity at 100° C. of 3 to 8 cSt, a viscosity index of 130 or more, and a flow point of −50° C. or less.

3. The axle oil composition of claim 1, wherein the oil soluble poly alkylene glycol (OSP) synthetic oil has average kinematic viscosity at 100° C. of 3 to 8 cSt, a viscosity index of 140 or more, and a flow point of −40° C. or less.

4. The axle oil composition of claim 1, wherein the ester-based viscosity modifier is a hybrid olefin ester copolymer having a backbone containing units induced from (i) $C_6$ or more of α-olefin monomers; and (ii) ethylenically unsaturated carboxylic acid.

5. The axle oil composition of claim 1, wherein the additive is at least one selected from a group consisting of a dithiophosphate-based wear-resistant agent, a calcium-based detergent dispersant, a phosphate ester-based friction modifier, a bis-succinimide type ashless dispersant, a polysulfide extreme pressure agent, and an antioxidant.

* * * * *